US008414341B2

(12) United States Patent
Wishart

(10) Patent No.: US 8,414,341 B2
(45) Date of Patent: Apr. 9, 2013

(54) PROTECTIVE COVER FOR A MOORING BUOY AND METHOD OF DEPLOYMENT

(76) Inventor: Charmaine Wishart, Cherry Hill, NJ (US)

( * ) Notice: Subject to any disclaimer, the term of this patent is extended or adjusted under 35 U.S.C. 154(b) by 325 days.

(21) Appl. No.: 12/806,987

(22) Filed: Aug. 25, 2010

(65) Prior Publication Data

US 2012/0048166 A1 Mar. 1, 2012

(51) Int. Cl.
*B63B 22/02* (2006.01)

(52) U.S. Cl. ..... 441/3

(58) Field of Classification Search ..... 114/230.1, 114/230.2, 230.26, 382; 441/1, 3, 6, 21, 441/23, 28, 30, 32
See application file for complete search history.

(56) References Cited

U.S. PATENT DOCUMENTS 6,928,950 B2 * 8/2005 Trammell et al. ..... 114/382
7,438,616 B2 * 10/2008 Nanson ..... 441/3

* cited by examiner

*Primary Examiner* — Daniel Venne
(74) *Attorney, Agent, or Firm* — Stuart M. Goldstein

(57) ABSTRACT

A protective cover for a mooring buoy utilizes a plurality of interconnected buoyant chambers, connected in series and separated by flexible spacers. A plurality of ballast filled chambers are located adjacent to and extend beneath the buoyant chambers. The ends of the cover are configured to be connected by snaps or equivalent attachment devices, to form a circular enclosure. A guide ring is connected to one of the buoyant chambers to allow the cover to be slid from the moored vessel, along mooring lines, and then over the buoy, such that the buoyant chambers remain at the waterline. The deployed cover thus provides protection from impact with the hull of the vessel by the buoy. A retrieval line is provided to withdraw the cover from the buoy and return it to the vessel when the vessel is departing the mooring. Included as well is the method of deploying the protective cover from a moored vessel onto a buoy.

20 Claims, 3 Drawing Sheets

PROTECTIVE COVER FOR A MOORING BUOY AND METHOD OF DEPLOYMENT

BACKGROUND OF THE INVENTION

Marine vessels often tie up to anchored mooring buoys at beaches, lakes, harbors, or similar sheltered mooring areas. The usual connection between vessel and buoy consists of a mooring line, which ensures that the vessel remains secured to the buoy. However, tide, wave, and wind conditions will cause the moored vessel to float around and about the buoy and, inevitably, will compel the hull of the vessel to come into contact with the buoy. Significant noise and vessel damage is often the result of hull to buoy contact. At the very least, vessel hulls become scraped and marred due to impact with mooring buoys. Also, as a result of the moored vessel floating around and about the buoy, the vessel's mooring lines will inevitably become entangled around the buoy's anchor chain.

Protective buoy covers, such as disclosed in U.S. Pat. No. 7,438,616, have been suggested. However, such covers are designed to be permanently installed over buoys. These covers eventually will deteriorate and generally lose their effectiveness. As a practical matter, such covers are cumbersome to install and, as a practical matter, can not possibly be placed on the myriad of vessel mooring buoys in use today. The solution is a protective buoy cover which can be carried as part of the vessel's equipment and which can be deployed when needed.

However, there is currently no protection device which is designed to be portable and stored onboard a vessel and which can be deployed from the vessel, while the vessel is actually moored to a buoy.

SUMMARY OF THE INVENTION

It is thus the object of the present invention to provide a protective cover for a mooring buoy which addresses the disadvantages and limitations of existing covers.

It is the object of the present invention to provide a protective cover for a mooring buoy which can be stored and carried on the vessel for use when needed on various mooring buoys.

It is another object of the present invention to provide a protective cover for a mooring buoy which can be deployed directly from a moored vessel, along its mooring line and onto the buoy itself.

It is a further object of the present invention to provide a protective cover for a mooring buoy which, once deployed onto the buoy, provides complete physical and acoustic protection for the moored vessel should it come into contact with the buoy.

It is another object of the present invention to prevent vessel mooring lines from becoming entangled around the buoy anchor chain.

It is still another object of the present invention to provide a protective cover for a mooring buoy which can easily and quickly be retrieved from the buoy, when the vessel is about to depart from the moorings.

These and other objects are provided by the invention, a protective cover for a mooring buoy and method of deployment of the cover. The protective cover comprises a plurality of interconnected buoyant chambers, connected in series and separated by flexible spacers. A plurality of ballast filled chambers are located adjacent to and extend beneath the buoyant chambers. The ends of the cover are configured to be connected by snaps or equivalent attachment devices, to form a circular enclosure. A guide ring is connected to one of the buoyant chambers to allow the cover to be slid from the moored vessel, along mooring lines, and then over the buoy, such that the buoyant chambers remain at the waterline. The deployed cover thus provides protection from impact with the hull of the vessel by the buoy. A retrieval line is provided to withdraw the cover from the buoy and return it to the vessel when the vessel is departing the mooring.

The novel features which are considered as characteristic of the invention are set forth in particular in the appended claims. The invention, itself, however, both as to its design, construction and use, together with additional features and advantages thereof, are best understood upon review of the following detailed description with reference to the accompanying drawings.

DETAILED DESCRIPTION OF THE INVENTION

Figure 1:
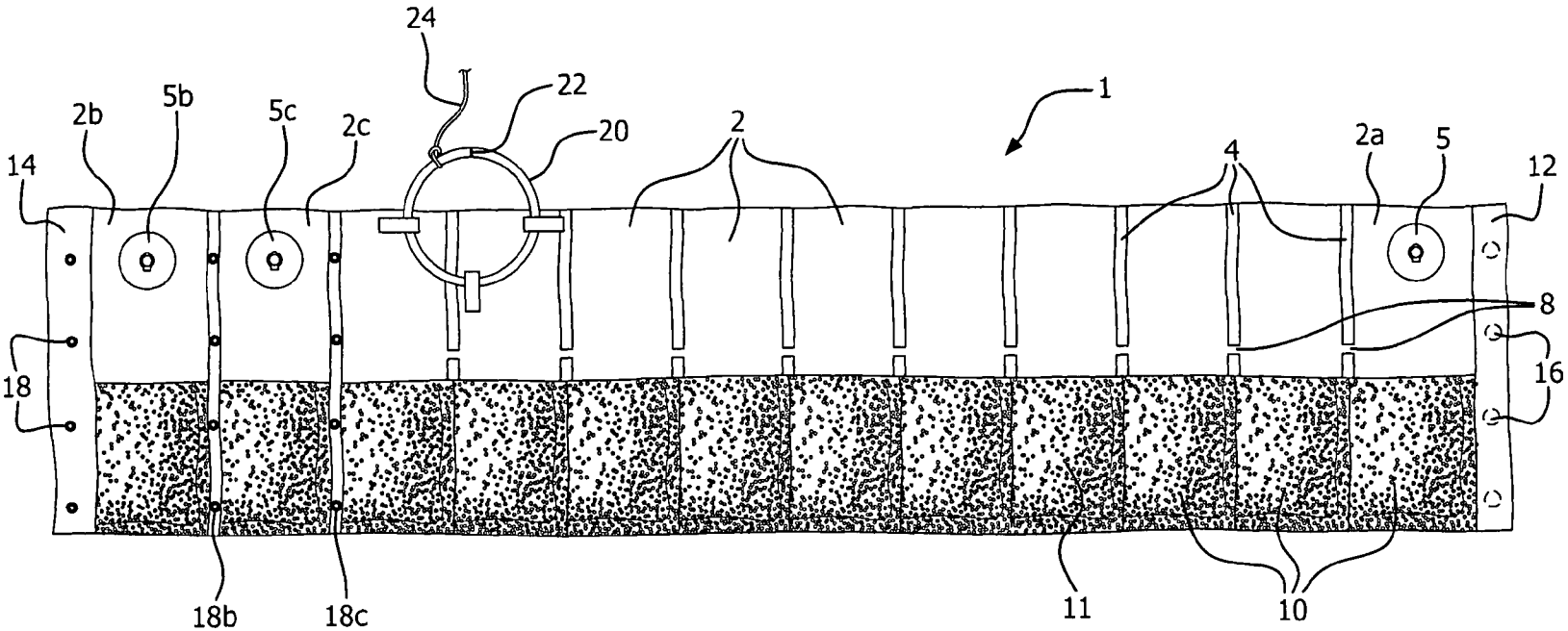
FIG. 1 shows the protective cover of the present invention in its stretched out position, prior to its being attached as a circular enclosure.

Protective buoy cover 1 comprises a plurality of air-tight, interconnected protective buoyant chambers 2, one adjacent to the other. Chambers 2 are separated by flexible spacers 4, optimally made of flexible, bendable plastic material. Chambers 2 can be air-filled sections, easily inflatable by means of air valve 5. Air entering chamber 2*a* via air valve 5 travels through air passages 8 within spacers 4 between the chambers, to inflate all the chambers. In lieu of inflatable sections, chambers 2 can be filled with buoyant, closed cell foam or equivalent buoyant material to provide the buoyant characteristics required for buoy cover 1. A plurality of sealed ballast filled chambers 10 is located adjacent to and beneath chambers 2. Ballast chambers 10 can be filled with sand 11 or equivalent weighted material.

Snaps or equivalent connectors 16 and 18 are configured to securely mate. These are provided at ends 12 and 14 of buoy cover 1. The connectors are designed to secure the ends of the buoy cover 1, comprising buoyant chambers 2 and ballast chambers 10, so that it becomes a circular, ring-shaped enclosure which is open at its top and bottom. Connectors 16 and 18 provide the means for securing buoyant chambers 2 and ballast filled chambers 10 to form a substantially circular enclosure.

The length of the operable, protective portion of buoy cover 1 can be adjusted, depending on the size of the buoy on which it is to be placed, by inflating and filling one or both chambers 2*b* and 2*c* with air, via their respective air valves 5*b* and 5*c*, these air valves providing the means to inflate and fill the chambers with air. Snap connectors 18*b* and 18*c* are configured to mate with snap connector 16, thus allowing buoy cover 1 to form smaller circular enclosures, to fit smaller diameter buoys.

Guide device or guide means 20 is connected to one of the buoyant chambers for supporting the passage of a mooring line between vessel 40 and mooring buoy 30. Guide device or guide means 20 is made of a rustproof material which will allow ends of the device to be slightly separated to form slit opening 22 therebetween, but which is also capable of biasedly compelling the ends together, to close the slit and maintain the integrity of the device's perimeter. Retrieval line 24 is connected to guide device or guide means 20 and comprises the means connected to guide device or guide means for removing cover 1 from buoy 30.

FIG. 1 shows buoy cover 1 in its stretched position, prior to having its ends 12 and 14 attached to form a circular enclosure.

Figure 2:
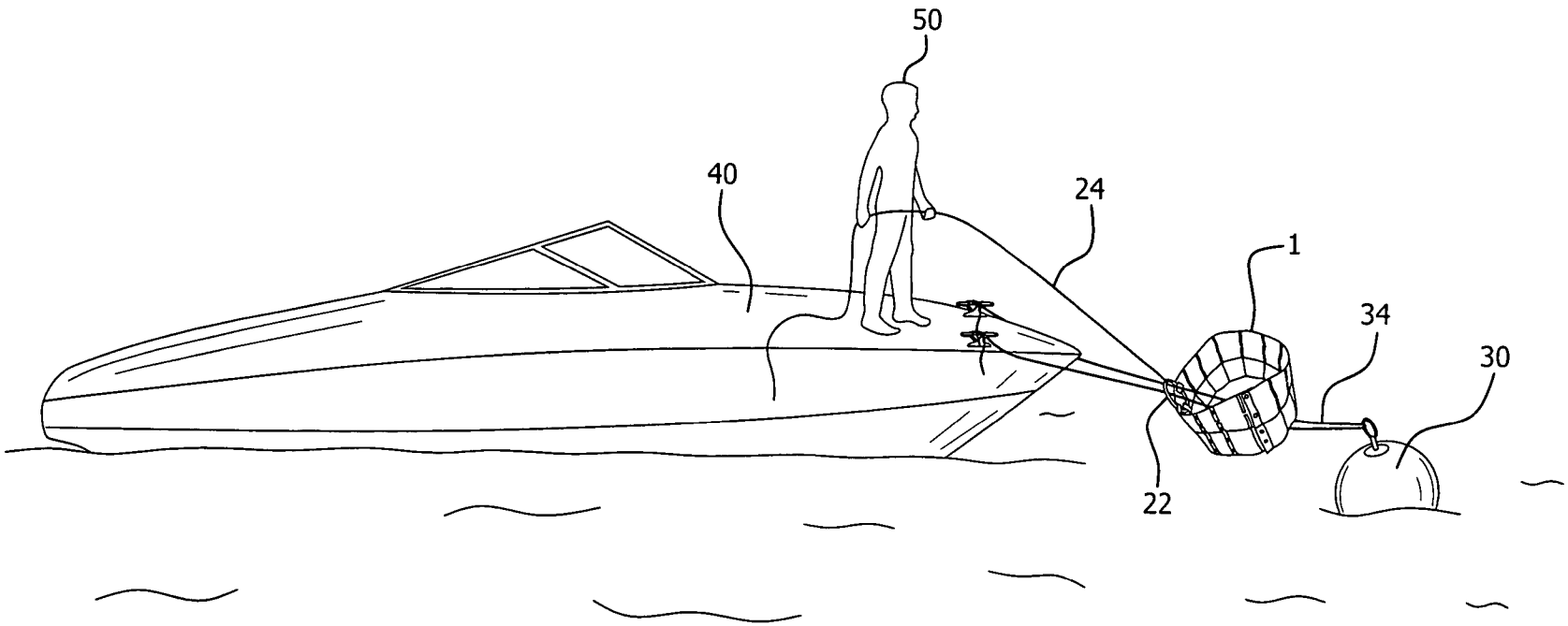
FIG. 2 shows the manner of deployment of the protective cover of the present invention from a moored vessel.
Figure 3:
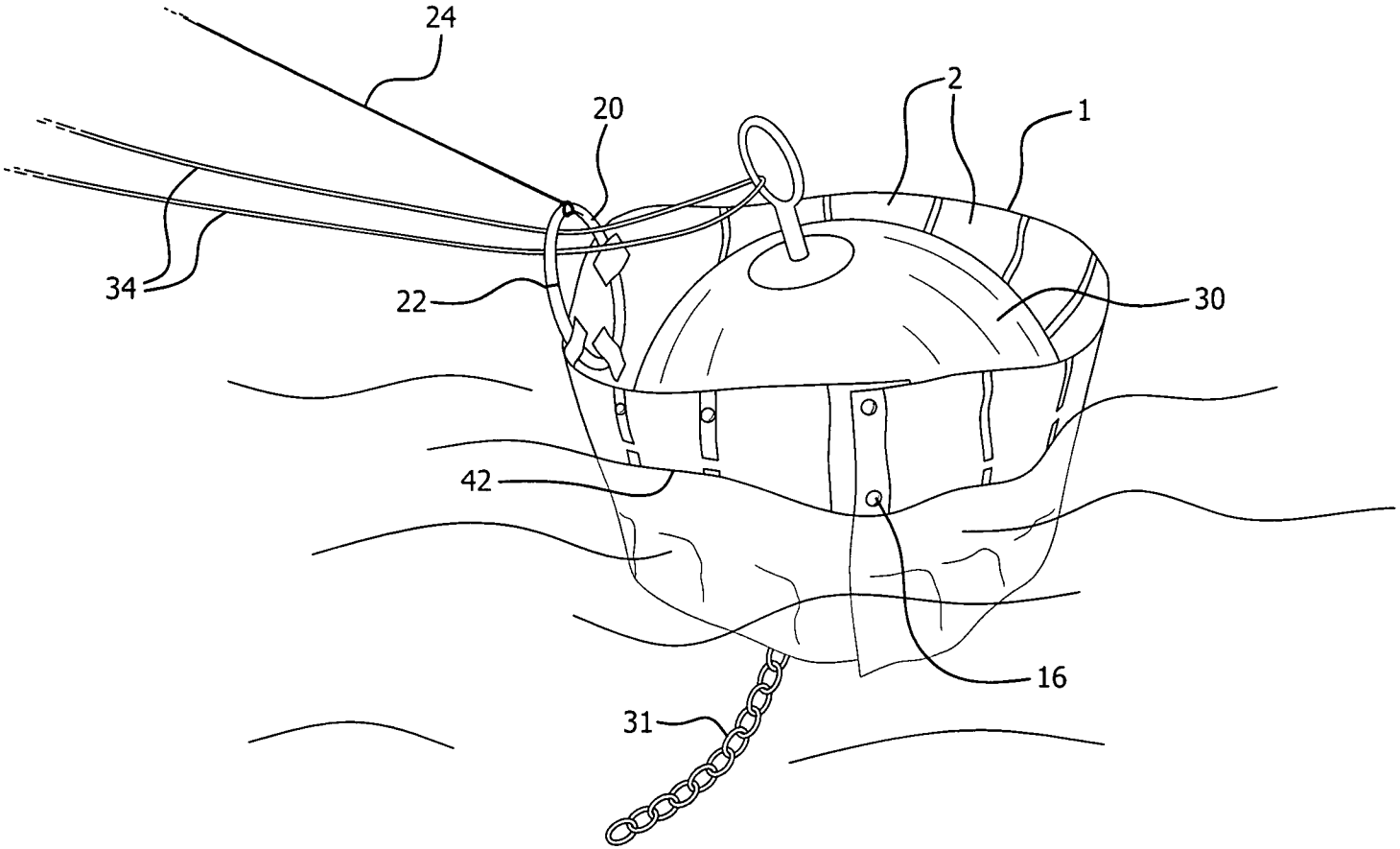
FIG. 3 shows the protective cover of the present invention positioned around a buoy.

FIG. 2 illustrates the use of buoy cover 1, after it is configured as a circular enclosure, and how it is to be deployed over buoy 30, floating in water but anchored to a seabed. Mooring line 34 secures vessel 40 to buoy 30. Buoy anchor chain 31 secures buoy 30 to the seabed via a commonly utilized anchor.

Buoy cover 1 is first formed as a circular enclosure around mooring line 34. Ends of guide device 20 are then slightly opened so that mooring line 34 can be inserted through slit opening 22 of and into the guide device. Buoy cover 1 is then dropped over the side of vessel 40 and slid along mooring line 34 until it contacts buoy 30. Once adjacent to buoy 30, the weight carried by ballast chambers 10 of buoy cover 1 causes the buoy cover to drop over and then down onto the buoy, such that buoyant chambers 2 surround the upper portion of the buoy and these ballast chambers are adjacent to and beneath the buoyant chambers. Ballast chambers 10 comprises the ballast means adjacent to and beneath the chambers for stabilizing and maintaining the cover in a vertical position around the mooring buoy. Buoy cover 1 is sized and weighted so that buoyant chambers 2 remain substantially at the waterline. Buoy cover 1 is maintained in this position around buoy 30 by means of ballast chambers 10 and the circumferential fit of the circular buoy cover 1 around the buoy. As previously discussed, buoy cover 1 is configured to accommodate the diameters of various standard buoys by the inflation of the appropriate number of buoyant chambers 2/2*b*/2*c*.

Once in place around buoy 30, buoy cover 1 provides a protective barrier around the buoy which will prevent noise and vessel hull damage due to contact between the hull of vessel 40 and buoy 30. In addition, guide device 20 prevents mooring line 34 from separating over the top of buoy 30, and becoming entangled around buoy anchor chain 31.

When it is necessary to remove buoy cover 1, crew member 50 aboard vessel 40 simply pulls on retrieval line 24. This causes buoy cover 1 to be withdrawn from buoy 30. Buoy cover 1 can then be pulled in, along mooring line 34, and placed on the deck of vessel 40. It then can be stowed until it is needed for the next buoy mooring.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A protective cover for a mooring buoy attached by mooring lines to a vessel, said cover comprising:

a plurality of interconnected buoyant chambers;

a plurality of ballast filled chambers located adjacent to and extending beneath the buoyant chambers;

guide means connected to one of the buoyant chambers for supporting the passage of mooring lines between the vessel and the mooring buoy; and means for securing the buoyant chambers and ballast filled chambers to form a substantially circular enclosure.

2. The protective cover for a mooring buoy as in claim 1 further comprising a retrieval line connected to the guide means.

3. The protective cover for a mooring buoy as in claim 1 wherein the buoyant chambers are filled with air.

4. A protective cover for a mooring buoy as in claim 3 further comprising means to inflate and fill the air filled chambers with air and wherein the air filled chambers are separated by flexible spacers which comprise through air passages.

5. The protective cover for a mooring buoy as in claim 1 wherein the buoyant chambers are separated by flexible spacers.

6. The protective cover for a mooring buoy as in claim 1 wherein the buoyant chambers are filled with buoyant material.

7. The protective cover for a mooring buoy as in claim 1 wherein the means for securing the buoyant chambers and ballast filled chambers comprise interconnecting snaps.

8. The protective cover for a mooring buoy as in claim 1 wherein the guide means comprises a device through which the mooring lines pass.

9. A protective cover for a mooring buoy attached by mooring lines to a vessel, said cover comprising:

a plurality of interconnected protective chambers forming a circular enclosure for circumscribing the mooring buoy;

ballast means adjacent to and beneath the chambers for stabilizing and maintaining the cover in a vertical position around the mooring buoy; and guide means connected to one of the chambers for supporting the passage of the mooring line between the vessel and the mooring buoy.

10. The protective cover for a mooring buoy as in claim 9 wherein the ballast means comprise a plurality of ballast filled chambers located adjacent to and extending beneath the protective chambers.

11. The protective cover for a mooring buoy as in claim 9 further comprising means connected to the guide means for removing the cover from the buoy.

12. The protective cover for a mooring buoy as in claim 11 wherein the means connected to the guide element comprises a retrieval line.

13. The protective cover for a mooring buoy as in claim 9 further comprising means for securing the protective chamber and ballast means to form a substantially circular enclosure.

14. The protective cover for a mooring buoy as in claim 9 wherein the protective chambers are filled with air.

15. The protective cover for a mooring buoy as in claim 14 further comprising means to inflate and fill the protective chambers with air and wherein the air filled chambers are separated by flexible spacers which comprise through air passages.

16. The protective cover for a mooring buoy as in claim 9 wherein the protective chambers are separated by flexible spacers.

17. The protective cover for a mooring buoy as in claim 13 wherein the means for securing comprises interconnecting snaps.

18. The protective cover for a mooring buoy as in claim 9 wherein the guide means comprises a device through which vessel mooring lines pass.

19. The protective cover for a mooring buoy as in claim 9 wherein the protective chambers are filled with buoyant material.

20. A method of deploying a protective buoy cover over a buoy from a vessel attached by a mooring line to the buoy, the method comprising the steps of:

providing a protective buoy cover having at least one buoyant protective chamber;

forming the protective cover into a circular enclosure;

sliding the circular enclosure formed protective cover along the mooring line so that it contacts the buoy;

positioning the circular enclosure formed protective cover over the buoy;

surrounding the buoy with the circular enclosure formed protective cover; and maintaining the circular enclosure formed protective cover around the buoy such that said at least one buoyant protective chamber shields the vessel from contact with the buoy.

* * * * *